US005697357A

United States Patent [19]

Chipman

[11] Patent Number: 5,697,357

[45] Date of Patent: Dec. 16, 1997

[54] PEEP SIGHT FOR ARCHERS

[76] Inventor: Donald L Chipman, 800 12th St. NW, P.O. Box 1103, Mason City, Iowa 50401

[21] Appl. No.: 679,584

[22] Filed: Jul. 15, 1996

[51] Int. Cl.[6] ..... F41G 1/467

[52] U.S. Cl. ..... 124/87; 124/90; 33/265

[58] Field of Search ..... 124/87, 90; 33/265

[56] References Cited

U.S. PATENT DOCUMENTS

| | | | |
|---|---|---|---|
| 3,410,644 | 11/1968 | McLendon | 33/265 X |
| 3,703,771 | 11/1972 | Saunders | 33/265 |
| 4,552,121 | 11/1985 | Treaster | 124/87 |
| 4,656,747 | 4/1987 | Troncoso | 33/265 |
| 4,833,786 | 5/1989 | Shores | 33/265 |
| 4,961,264 | 10/1990 | Topel | 33/265 |
| 5,137,007 | 8/1992 | Shoemake et al. | 124/87 |
| 5,347,976 | 9/1994 | Saunders | 124/87 |

*Primary Examiner*—John A. Ricci

[57] ABSTRACT

A peep sight for installation on a bow string includes an outer barrel with notches to receive a divided bowstring, and a through bore including an inner chamber. A carrier is threaded into the chamber and includes a through bore including an inner socket. An aperture piece with a tapered sighting hole is received in the socket, and a lens is received in the socket adjacent the aperture piece. The lens collects light to aid in viewing the target.

2 Claims, 1 Drawing Sheet

PEEP SIGHT FOR ARCHERS

BACKGROUND AND SUMMARY OF THE INVENTION

The invention pertains to peep sights for archery units and is an improvement on the peep sight disclosed in U.S. Pat. No. 5,137,007 issued Aug. 11, 1992 to Shoemake, et al. That patent describes a bow shooting system for an archer which includes a peep sight combined with a front or pin sight and an improved nocking arrangement for the engagement between the arrow nock and the bowstring.

Although that system works well, the peep sight has some shortcomings. For example, as the aperture gets smaller, less light reaches the eye of the archer. Thus the target seems darker and is less clear. At the wide open aperture, there is lots of light so the quality of light is adequate, but the field of vision also widens and the area of the target is less concentrated.

Both of these problems lend themselves to a single solution as proposed in this application. The use of a small lens within the sight, applicant provides a device which can gather and concentrate enough light to make the target easy to see and also can apparently enlarge the target so that the center can appear more concentrated to assist the archer in aiming his arrow at the heart of the target. It may be noted that the peep sight works whether the other part of the sighting device is either a pin sight or a scope sight. In fact, users have indicated that the improvement is even greater in the scope sight than a pin sight.

DESCRIPTION

Figure 1:
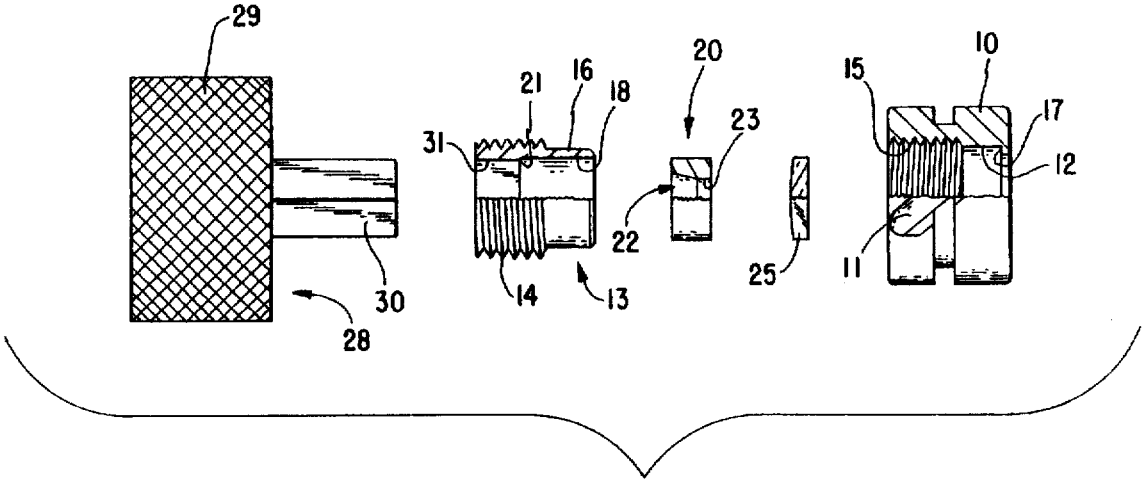
FIG. 1 is a an exploded view of the device and its wrench disassembled.
Figure 2:
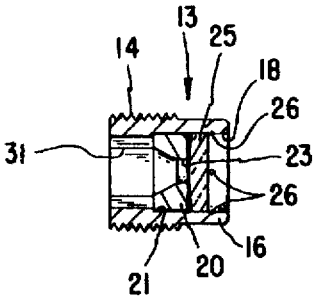
FIG. 2 is a sectional view of the lens holder assembled.
Figure 3:
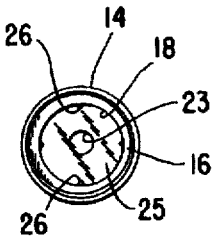
FIG. 3 is an end view of the lens holder shown in FIG. 2.

Briefly this invention comprises an improved archers' peep-sight for use on the bow used to propel the arrows particularly in target shooting. The improvement consists primarily in the use of a lens in a unique mounting designed to improve the visibility through the sight.

More specifically and in reference to the drawings, the basic peep sight includes an outer barrel 10. External notches 11 are provided so that the barrel may be held in a divided bowstring in a manner known in the art. Internally, the barrel provides a chamber 12 into which a carrier 13 fits.

The carrier 13 includes a threaded part 14 of slightly larger outer diameter then the rest of the carrier. This threaded part fits into an internally threaded socket 15 in the barrel 10. Extending from the threaded part 14 is a projecting section 16 adapted to engage a shoulder 17 in the barrel. A cylindrical socket 18 is formed in that end of the carrier 13 which abuts the shoulder 17.

An aperture piece 20 is fitted into the socket 18 and abuts against a shoulder 21 in that socket. This piece is formed with a hole 22 completely through the piece. The hole may be tapered to a smallest diameter section to form a desired aperture 23 through which the target is sighted. The diameters may vary from piece to piece so that an aperture piece 20 may be selected to provide the optimum sighting for the present light conditions.

The novel lens 25 is fitted into the socket 18, and is held there by forming small crimpings 26 in the material of the carrier 14. The provision of this small feature is the one thing that allows the sight to be as useful as it is. Particularly with a small aperture 23, the lens collects enough light to allow the target to be seen clearly and thus provides much easier and more accurate shooting by the archer.

To ease the assembly of the sight, a wrench 28 may be provided. The wrench includes a knurled cylindrical handle 29 and a multi-sided wrench member 30 extending therefrom. The wrench member 30 is fitted into a mating wrench socket 31 in the carrier 13 in a well known manner. Thus, the wrench 28 may be used both to hold the carrier 13 for inserting into the barrel 10 and to run the screw threaded parts together to assemble the device properly for use.

I claim as my invention:

1. For sighting arrows to be shot by an archer from a bow having a bowstring, a peep sight comprising a body including a barrel adapted to be held by said bowstring, said barrel having an internal aperture with internal screw threads, carrier means for carrying a lens, said carrier means being threadably engaged with said internal screw threads, said carrier means having an axial aperture therethrough, and a lens removably held by said carrier means within said axial aperture, aperture means for forming a calibrated aperture fitted into said carrier means, said aperture means being formed with said calibrated aperture varying in diameter from the desired size nearest said lens to another size remote from said lens.

2. The sight of claim 1 in which said carrier means is formed to provide an aperture means receiving socket, said aperture means and said lens being of the same diameter and slidably fitted into said receiving socket, said receiving socket having walls surrounding said lens and said aperture means, said walls being crimped to hold said lens and said aperture means in place in said receiving socket.

* * * * *